US010538406B2

(12) United States Patent
Ohta et al.

(10) Patent No.: US 10,538,406 B2
(45) Date of Patent: Jan. 21, 2020

(54) IMAGE FORMING APPARATUS, IMAGE FORMING METHOD AND SHEET PROCESSING APPARATUS

(71) Applicant: CANON KABUSHIKI KAISHA, Tokyo (JP)

(72) Inventors: Yuya Ohta, Abiko (JP); Shunsuke Nishimura, Tokyo (JP); Takuya Hayakawa, Koshigaya (JP); Naoka Omura, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/176,635

(22) Filed: Jun. 8, 2016

(65) Prior Publication Data

US 2016/0376120 A1 Dec. 29, 2016

(30) Foreign Application Priority Data

Jun. 26, 2015 (JP) ..... 2015-128934

(51) Int. Cl.

*B65H 37/04* (2006.01)
*G03G 15/00* (2006.01)
*B42C 1/12* (2006.01)

(52) U.S. Cl.

CPC ..... *B65H 37/04* (2013.01); *G03G 15/6541* (2013.01); *B42C 1/12* (2013.01); *B65H 2407/21* (2013.01); *B65H 2408/1222* (2013.01); *B65H 2511/20* (2013.01); *B65H 2511/21* (2013.01); *B65H 2511/51* (2013.01);
(Continued)

(58) Field of Classification Search

CPC ..... B65H 2408/122; B65H 2601/423; B65H 2601/2525; B65H 2408/1223; B65H 2408/1222

See application file for complete search history.

(56) References Cited

U.S. PATENT DOCUMENTS 5,095,369 A * 3/1992 Ortiz ..... G03G 15/50 358/296
5,177,548 A * 1/1993 Nakamura ..... G03G 15/6541 270/58.05

(Continued)

FOREIGN PATENT DOCUMENTS

JP H02-38265 A 2/1990
JP 2002-326763 A 11/2002

(Continued)

OTHER PUBLICATIONS

Office Action dated Feb. 5, 2019, in Japanese Patent Application No. 2015-128934.

*Primary Examiner* — Jennifer E Simmons
(74) *Attorney, Agent, or Firm* — Venable LLP

(57) ABSTRACT

An image forming system comprises an image forming apparatus for forming an image on a sheet and a sheet processing apparatus for performing binding processing on a sheet bundle formed of a plurality of sheets having formed the image. The sheet processing apparatus performs binding processing by a stapler on the sheet bundle placed on an intermediate tray and an opening. The image forming apparatus controls image forming preparation and timing of movement of the stapler in accordance with presence/absence of the sheet bundle on the opening, position of the stapler and timing to obtain an image forming instruction including binding processing.

9 Claims, 11 Drawing Sheets

(52) U.S. Cl.
CPC .. *B65H 2511/515* (2013.01); *B65H 2513/512* (2013.01); *B65H 2601/2525* (2013.01); *B65H 2601/423* (2013.01); *B65H 2801/27* (2013.01); *G03G 2215/00827* (2013.01)

(56) References Cited

U.S. PATENT DOCUMENTS

| | | | | |
|---|---|---|---|---|
| 7,021,616 | B2 | 4/2006 | Mizuta et al. | |
| 7,331,573 | B2 | 2/2008 | Mizuta et al. | |
| 7,878,495 | B2 | 2/2011 | Nishimura et al. | |
| 7,938,388 | B2 | 5/2011 | Fujii et al. | |
| 8,393,372 | B2 | 3/2013 | Yamauchi et al. | |
| 8,413,978 | B2 | 4/2013 | Watanabe et al. | |
| 8,628,073 | B2 | 1/2014 | Watanabe et al. | |
| 8,662,487 | B2 | 3/2014 | Watanabe et al. | |
| 9,079,743 | B2 | 7/2015 | Ando et al. | |
| 10,046,940 | B2 | 8/2018 | Obuchi et al. | |
| 2010/0117288 | A1* | 5/2010 | Taki | B42B 4/00 270/58.08 |
| 2010/0247203 | A1 | 9/2010 | Watanabe et al. | |
| 2012/0325062 | A1* | 12/2012 | Terao | B26D 5/16 83/13 |
| 2014/0020533 | A1 | 1/2014 | Watanabe et al. | |
| 2015/0014913 | A1* | 1/2015 | Obuchi | B65H 31/36 270/58.12 |

FOREIGN PATENT DOCUMENTS

| | | | | |
|---|---|---|---|---|
| JP | 2005-250271 | A | | 9/2005 |
| JP | 2005250271 | A | * | 9/2005 |
| JP | 2007145499 | A | * | 6/2007 |
| JP | 2009018932 | A | * | 1/2009 |
| JP | 2015-016973 | A | | 1/2015 |

* cited by examiner

IMAGE FORMING APPARATUS, IMAGE FORMING METHOD AND SHEET PROCESSING APPARATUS

BACKGROUND OF THE INVENTION

Field of the Invention

The present disclosure relates to an image forming apparatus for forming an image on a sheet comprising a sheet processing apparatus for performing binding processing on a sheet bundle formed of a plurality of sheets.

Description of the Related Art

As a post-processing apparatus of the image forming apparatus, a sheet processing apparatus is widely used. The sheet processing apparatus is an apparatus which performs binding processing using a stapler on a sheet bundle formed of a plurality of sheets having formed an image by the image forming apparatus. The sheet processing apparatus automatically binds the sheet delivered from the image forming apparatus. In this specification, such binding processing is called "online-stapling". Further, the sheet processing apparatus may comprise an opening into which a user can manually insert the sheet bundle. In this case, the sheet processing apparatus binds the sheet bundle inserted into the opening. In this specification, such binding processing is called "offline-stapling".

Japanese Patent Application Laid-open No. H02-38265 discloses a post-processing apparatus of an image forming apparatus. In the post-processing apparatus, a stapler is configured to be movable so that the online-stapling and the offline-stapling can be performed with one stapler, which reduces cost. The post-processing apparatus moves the stapler when performing the online-stapling and the offline-stapling and performs the binding processing at different positions.

By decreasing a distance between a position where the stapler performs the online-stapling (online-stapling position) and a position where the stapler performs the offline-stapling (offline-stapling position), a size of the sheet processing apparatus can be reduced. However, if the size of the sheet processing apparatus is reduced, the sheet bundle inserted into the opening is positioned on a moving path of the stapler. Thereby, if the stapler moves in a state in which the sheet bundle is inserted into the opening, the stapler interferes with the sheet bundle. Due to the interference of the stapler with the sheet bundle, the sheet is damaged. This also causes an error of the stapler.

In response to an image forming request including the online-stapling, the image forming apparatus starts to prepare for image formation. When the image forming apparatus moves the stapler from the offline-stapling position to the online-stapling position, if the sheet bundle is inserted into the opening, the moving stapler interferes with the sheet bundle, which damages the sheet bundle. On the other hand, if the image forming apparatus waits for the movement of the stapler until the sheet bundle is removed, the image forming apparatus idly rotates component during a time period until the sheet bundle is removed while the image forming apparatus is preparing for the image formation. Due to prolonged idle rotation, a surface of a photosensitive drum is scraped and developer is deteriorated, which influences a lifetime of the component. Thereby, an image forming apparatus capable of preventing the damage of the sheet bundle and preventing the idle rotation of the component even in a case where the stapler interferes with the sheet bundle when moving the stapler while preparing for the image formation is required.

SUMMARY OF THE INVENTION

The image forming apparatus of the present invention comprises an image forming unit configured to form an image on a sheet; a binding unit configured to perform binding processing on a sheet bundle formed of a plurality of the sheets; a first sheet bundle placing portion on which the sheet bundle formed of a sheet conveyed from the image forming unit is placed; a second sheet bundle placing portion on which a sheet bundle inserted from outside is placed, the second sheet bundle placing portion being different from the first sheet bundle placing portion; a moving unit configured to move the binding unit between a first position and a second position, the first position being a position for binding the sheet bundle placed on the first sheet bundle placing portion and the second position being a position for binding the sheet bundle placed on the second sheet bundle placing portion, wherein, the moving unit moves the binding unit along a path which causes the sheet bundle on the second sheet bundle placing portion to interfere with the binding unit; a detecting unit configured to detect presence/absence of the sheet bundle on the second sheet bundle placing portion; and a control unit configured to control image forming preparation by the image forming unit and timing of movement of the binding unit in accordance with a detection result of the detecting unit, a position of the binding unit, and timing to obtain an image forming instruction including binding processing to be performed on the sheet bundle.

Further features of the present invention will become apparent from the following description of exemplary embodiments (with reference to the attached drawings).

DESCRIPTION OF THE EMBODIMENTS

In the following, embodiments are described in detail with reference to the accompanying drawings.

(Image Forming System)

Figure 1:
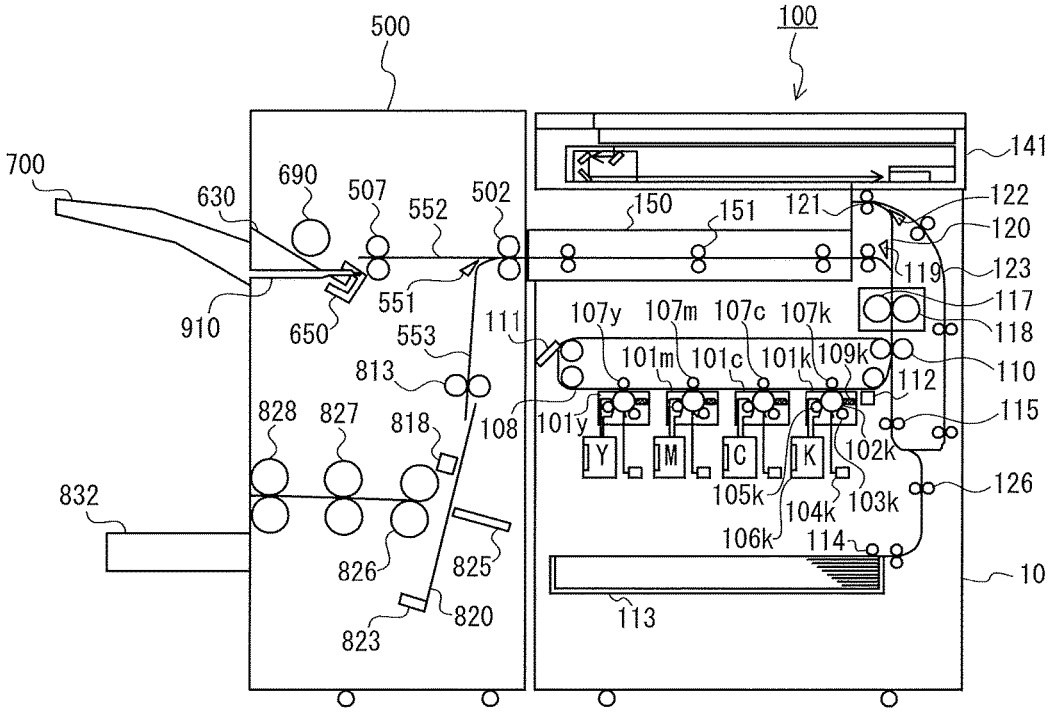
FIG. 1 is an overall configuration diagram of an image forming system.

FIG. 1 is an overall configuration diagram of an image forming system of the present embodiment. The image forming system comprises an image forming apparatus 100 and a finisher 500 which is a sheet processing apparatus. The image forming apparatus 100 comprises an image reading section 141 and a printer section 10. The image reading section 141 comprises a platen. The image reading section 141 reads an image of an original from the original placed on the platen to generate image data. The image reading section 141 inputs the image data generated into the printer section 10.

(Image Forming Apparatus)

To form the image of each color, i.e., yellow (Y), magenta (M), cyan (C), and black (B), the printer section 10 comprises process units 101*y*, 101*m*, 101*c* and 101*k*, which respectively correspond to each color in order. The process unit 101*y* forms a yellow image. The process unit 101*m* forms a magenta image. The process unit 101*c* forms a cyan image. The process unit 101*k* forms a black image. The process units 101*y*, 101*m*, 101*c* and 101*k* respectively have the same configuration. Here, a description is provided with regard to the configuration of the process unit 101*k* for black and the description with regard to the rest of the process units 101*y*, 101*m*, and 101*c* is omitted. It is noted that the alphabets of "y", "m", "c", and "k", placed at the end of each numeral are attached to respectively distinguish yellow, magenta, cyan, and black. In a case where no "y", "m", "c", and "k" is attached, distinction between colors will not be made.

The process unit 101*k* comprises a photosensitive drum 102*k*, a charging roller 103*k*, a developing device 105*k*, and an auxiliary charging brush 109*k*. A laser scanner unit 104*k*, a toner bottle 106*k*, a primary transfer roller 107*k*, and an intermediate transfer body 108 are arranged near the process unit 101*k*.

The photosensitive drum 102*k* is arranged at a center of the process unit 101*k*, which is rotationally driven by a drum motor (not shown). By applying high voltage, the charging roller 103*k* uniformly charges a surface of the photosensitive drum 102*k*. The laser scanner unit 104*k* scans the surface of the photosensitive drum 102*k* which is uniformly charged by laser light modulated by the image data. By the laser light scanning, an electrostatic latent image is formed on the surface of the photosensitive drum 102*k* according to the image data. Two-component developer including a toner and a carrier is adhered on the surface of the photosensitive drum 102*k* by the developing device 105*k* to develop the electrostatic image to form toner image. Here, a black toner image is formed. The toner for black is supplied to the developing device 105*k* from the toner bottle 106*k*. The primary transfer roller 107*k* transfers the toner image formed on the surface of the photosensitive drum 102*k* to the endless belt-shaped intermediate transfer body 108. The auxiliary charging brush 109*k* applies voltage to residual toner having failed to be transferred to the intermediate transfer body 108 and thus remaining on the surface of the photosensitive drum 102 to uniformly charge the residual toner.

Similarly, the process units 101*y*, 101*m*, and 101*c* respectively form the toner images of the corresponding color on the photosensitive drums 102*y*, 102*m*, and 102*c*. Each of the toner images formed is then transferred to the intermediate transfer body 108 by the primary transfer rollers 107*y*, 107*m*, and 107*c*. The toner images of each color are overlappingly transferred to the intermediate transfer body 108. Thereby, a full-color toner image is formed on the intermediate transfer body 108.

A secondary transfer roller 110, an intermediate transfer body cleaner 111, and a pattern density sensor 112 are arranged near the intermediate transfer body 108. The intermediate transfer body 108 is rotationally driven by a motor (not shown) and conveys the toner image formed to the secondary transfer roller 110. The pattern density sensor 112 detects density of the toner image formed on the intermediate transfer body 108. The detection result of the density is fed back to the developing device 105 and the laser scanner unit 104 and used to adjust the image.

A sheet is conveyed to the secondary transfer roller 110 in accordance with timing at which the toner image formed on the intermediate transfer body 108 is conveyed. The sheet is stored in a sheet cassette 113 and fed by a sheet feeding roller 114 in accordance with timing at which the toner image is formed. The sheet fed is conveyed to a registration roller 115 by a conveyance roller 126. The registration roller 115 performs skew correction of the sheet and conveys the sheet to the secondary transfer roller 110. The secondary transfer roller 110 transfers the toner image to be formed on the intermediate transfer body 108 to the sheet. The intermediate transfer body cleaner 111 removes the residual toner having failed to be transferred to the sheet and thus remaining on the intermediate transfer body 108.

With a fixing roller 117 and a pressurizing roller 118, the toner image is thermally fixed on the sheet having the toner image transferred. Due to this, the image is fixed on the sheet. When the sheet having the image fixed is delivered outside the image forming apparatus 100, the sheet is conveyed to an intermediate conveyance unit 150 by a delivery flapper 119. When the image is formed on both sides, the sheet is conveyed to a double-sided reverse path 120 by the delivery flapper 119. The sheet conveyed to the double-sided reverse path 120 is then conveyed to the registration roller 115 via a double-sided conveyance path 123 by a reverse roller 121 and a reverse flapper 122. Then, the toner image is transferred and thermally fixed on the sheet again.

The intermediate conveyance unit 150 comprises an intermediate conveyance roller 151. The intermediate conveyance roller 151 conveys the sheet to the finisher 500.

(Finisher)

The finisher 500 takes in the sheet having the image formed by the printer section 10 (image forming apparatus 100) to perform post-processing. The post-processing includes processing for aligning a number of sheets consisting one bundle and stacking the number of sheets as one sheet bundle, processing for binding the sheet bundle, sorting processing, non-sorting processing and bookbinding processing. The sheet binding processing includes online-stapling and offline-stapling. The online-stapling is performed on the sheet bundle formed of a plurality of sheets taken in from the image forming apparatus 100. The offline-stapling is performed on the sheet bundle which is manually placed by a user.

The finisher 500 comprises an inlet roller pair 502 for taking the sheet delivered from the printer section 10 in the apparatus. A switching flapper 551 for guiding the sheet to a first finisher path 552 or a second finisher path 553 is arranged on a downstream side of a conveying direction of the inlet roller pair 502. The switching flapper 551 guides the sheet to the first finisher path 552 when the post-processing other than the bookbinding processing is performed. The switching flapper 551 guides the sheet to the second finisher path 553 when the bookbinding processing is performed.

The sheet guided to the first finisher path 552 is placed on an intermediate tray 630 by a conveyance roller 507. The sheet placed on the intermediate tray 630 is aligned by two alignment plates (not shown) which are arranged parallel in a direction which is orthogonal to the conveying direction and by a bundle delivery roller 690. The sheet is aligned by the sheet bundle formed of the number of sheets consisting one bundle on the intermediate tray 630. When the binding processing is not performed, the sheet bundle is delivered to a delivery tray 700 as it is by the bundle delivery roller 690. When the binding processing is performed, the sheet bundle is bound by a stapler 650 on the intermediate tray 630 and delivered to the delivery tray 700 by the bundle delivery roller 690. The intermediate tray 630 is a sheet bundle placement section where the sheet bundle is placed when performing the online-stapling.

The sheet guided to the second finisher path 553 is conveyed by a conveyance roller 813 until a leading edge of the sheet contacts a movable sheet positioning member 823. Then, the sheet is stored in a storing guide 820. Two pairs of staplers 818 are arranged on a downstream side of a conveying direction of the conveyance roller 813, i.e., in the middle position of the storing guide 820. The stapler 818 performs the binding processing at a center of the sheet bundle. To match the stapling position of the sheet bundle bound by the stapler 818 with a center position (nip point) of a folding roller pair 826, the positioning member 823 lowers by a predetermined distance from a position at which the binding processing is performed on the sheet bundle. A thrusting member 825 is arranged facing the folding roller pair 826. The thrusting member 825 thrusts toward the sheet bundle stored in the storing guide 820 so that the sheet bundle is pushed between the folding roller pair 826. The folding roller pair 826 conveys the sheet bundle while folding the sheet bundle. Thereby, centering on the position at which the binding processing is performed, the sheet bundle is folded. Then, the folded sheet bundle is delivered on a delivery tray 832 through an intermediate roller 827 and a delivery roller 828.

The finisher 500 is provided with an opening 910. The opening 910 is a sheet bundle placement section where the sheet bundle is placed when performing the offline-stapling.

(Controller)

Figure 2:
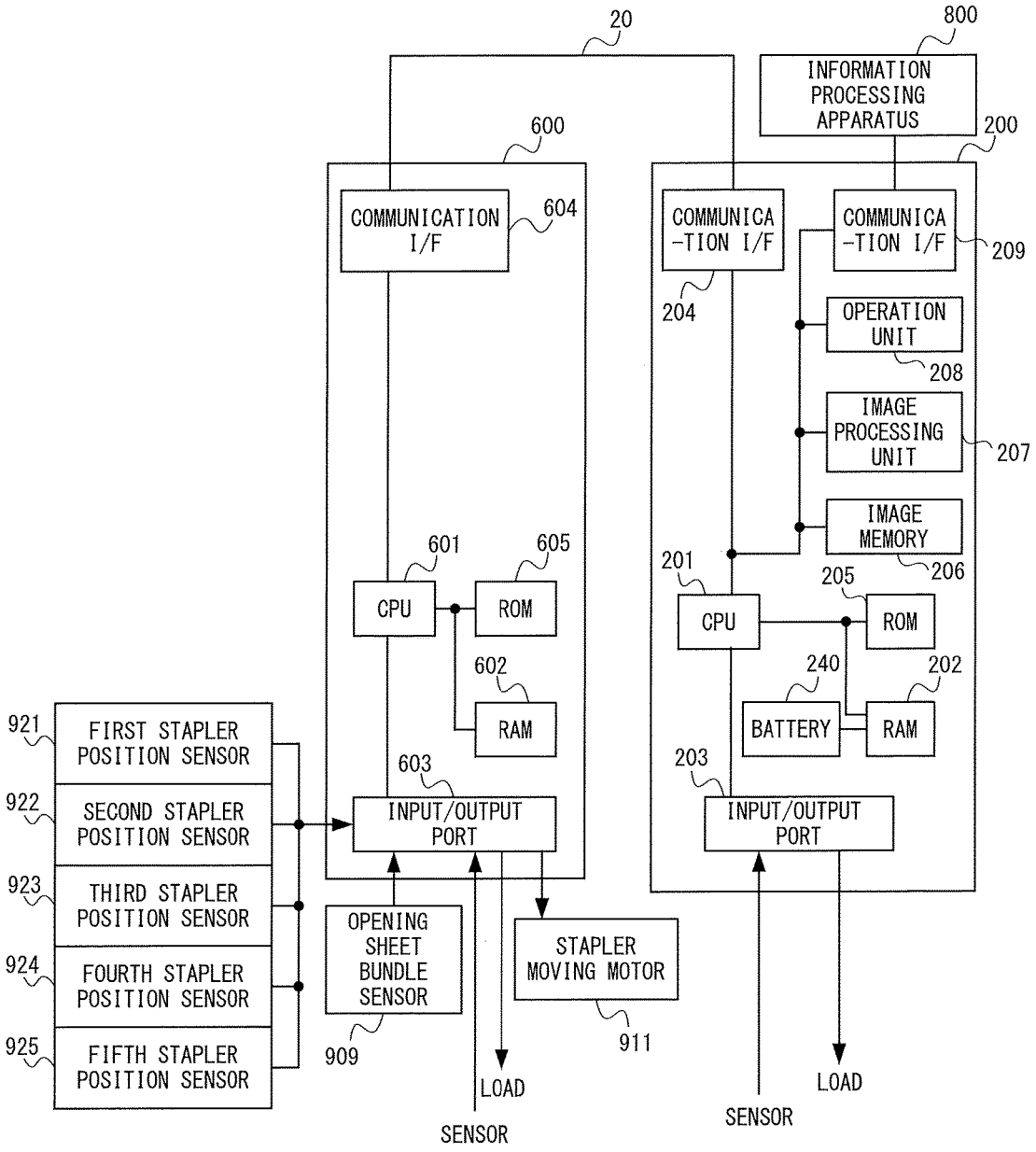
FIG. 2 is a configuration diagram of a controller.

FIG. 2 is a configuration diagram of a controller for controlling operation of the image forming system of above configuration. The controller comprises a first control unit 200 and a second control unit 600. The first control unit 200 is provided in the image forming apparatus 100 and controls operation of each unit of the image forming apparatus 100. The second control unit 600 is provided in the finisher 500 and controls operation of each unit of the finisher 500. The first control unit 200 and the second control unit 600 are communicably connected to each other by a communication cable 20. Further, the first control unit 200 can establish communication via network with an information processing apparatus 800 which is an external device.

The first control unit 200 obtains a detection result by various sensors provided in the image forming apparatus 100 and outputs control signal of various loads, such as motors, clutches and the like, in the image forming apparatus 100. The first control unit 200 comprises a central processing unit (CPU) 201, a read only memory (ROM) 205, and a random access memory (RAM) 202. The CPU 201 controls operation of the image forming apparatus 100 by reading a program from the ROM 205 and executing the computer program using the RAM 202 as a work area. Voltage is supplied to the RAM 202 from a battery 240. Thereby, data stored in the RAM 202 is held even a power source of the image forming apparatus 100 is shut down. In addition, the first control unit 200 comprises an input/output port 203, a communication interface (I/F) 204, an image memory 206 for storing image data, an image processing unit 207, an operation unit 208, and a communication I/F 209.

The input/output port 203 is connected to the CPU 201 by an address bus and a data bus. The input/output port 203 obtains a detection result by various sensors and inputs the obtained result into the CPU 201. Further, the input/output port 203 obtains control signals for various loads from the CPU 201 and inputs the control signals into the various loads. The load operates in accordance with the control signal, through which sheet conveying processing, image forming processing and the like are performed.

The communication I/F 204 controls communication between the CPU 201 and the second control unit 600. By establishing communication with the second control unit 600 via the communication I/F 204, the CPU 201 performs control relating to the finisher 500 including sheet delivery, post-processing, state display and the like.

The operation unit 208, receiving an instruction from a user and providing information to the user, is an input/output interface. Thereby, the operation unit 208 comprises various key buttons, a touch panel, a display and the like. The operation unit 208 inputs instruction, data and the like input through the key button and the touch panel into the CPU 201. Through the control of the CPU 201, the operation unit 208 shows an operation state, an error, and a guide on the display.

The communication I/F 209 controls communication between the CPU 201 and the information processing apparatus 800. The CPU 201 obtains the image data, a print instruction, a print condition and the like from the information processing apparatus 800 via the communication I/F 209. The image data is stored in the image memory 206. It is noted that the CPU 201 can also obtain the image data from the image reading section 141 and store the obtained data in the image memory 206. The image processing unit 207 performs predetermined image processing to the image data stored in the image memory 206.

The second control unit 600 obtains detection results by various sensors provided in the finisher 500 and outputs control signals for various loads, such as motors, clutches and the like, in the finisher 500. The second control unit 600 comprises a CPU 601, a ROM 605, and a RAM 602. The CPU 601 controls operation of the finisher 500 by reading program from the ROM 605 and executing the program using the RAM 602 as a work area. In addition, the second control unit 600 comprises an input/output port 603 and a communication I/F 604.

The input/output port 603 is connected to the CPU 601 by an address bus and a data bus. The input/output port 603 obtains a detection result by various sensors and inputs the obtained result into the CPU 601. Further, the input/output port 603 obtains control signals of various loads from the CPU 601 and inputs the control signals into the various loads. The load operates in accordance with the control signal, through which the post-processing of various kinds is performed by the finisher 500. The sensor through which the CPU 601 obtains the detection result includes, for example, an opening sheet bundle sensor 909, a first stapler position sensor 921, a second stapler position sensor 922, a third stapler position sensor 923, a fourth stapler position sensor 924 and a fifth stapler position sensor 925 (described later). The load to which the CPU 601 inputs the control signal includes, for example, a stapler moving motor 911 (described later).

The communication I/F 604 controls communication between the CPU 601 and the first control unit 200. By establishing communication with the first control unit 200 via the communication I/F 604, the CPU 601 performs operation control of the sheet delivery, the binding processing and the like. Further, the CPU 601 notifies the first control unit 200 whether the stapler 650 can move or not via the communication I/F 604.

(Binding Processing)

Figure 3:
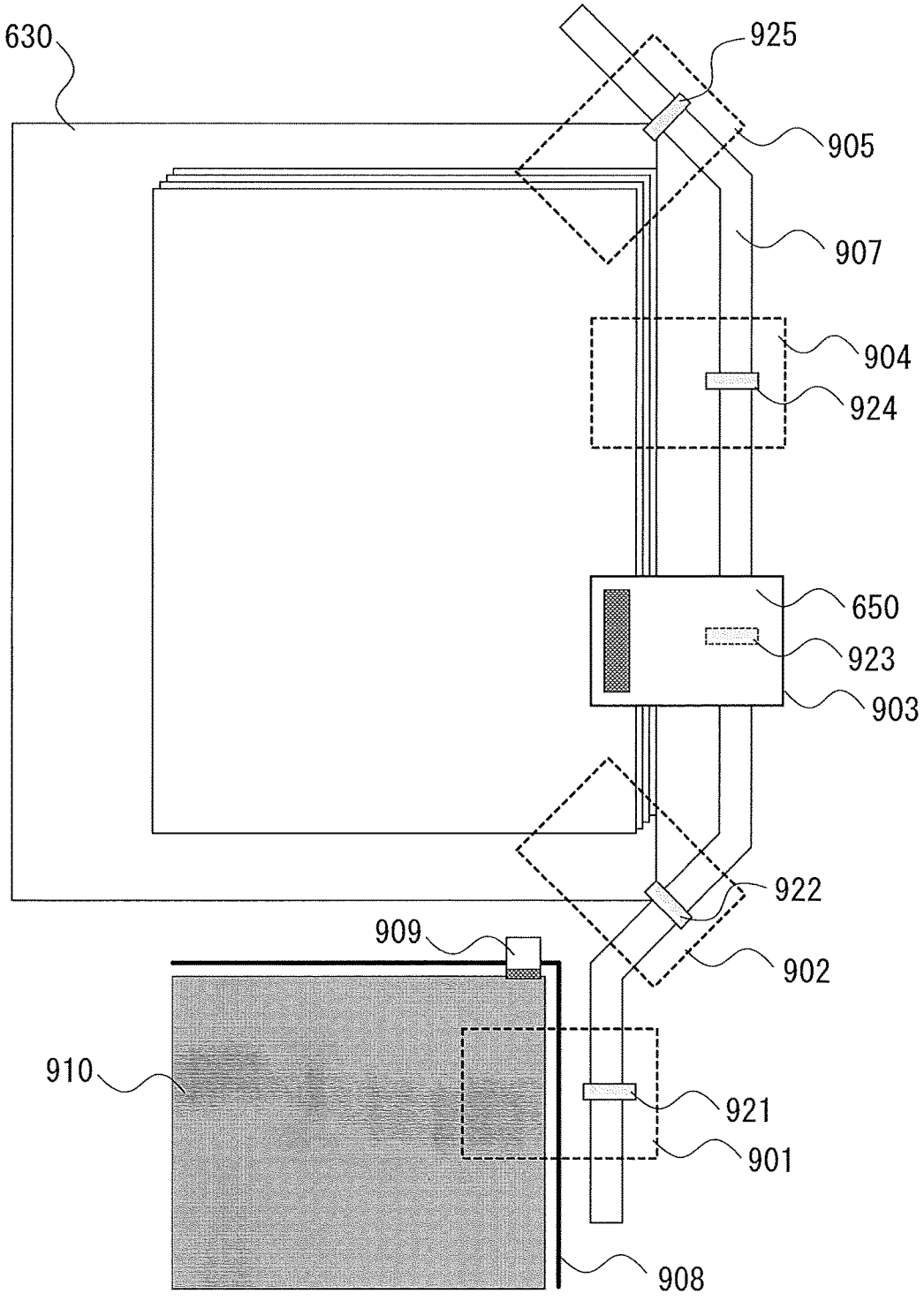
FIG. 3 is an explanatory diagram of a position of the stapler.
Figure 4:
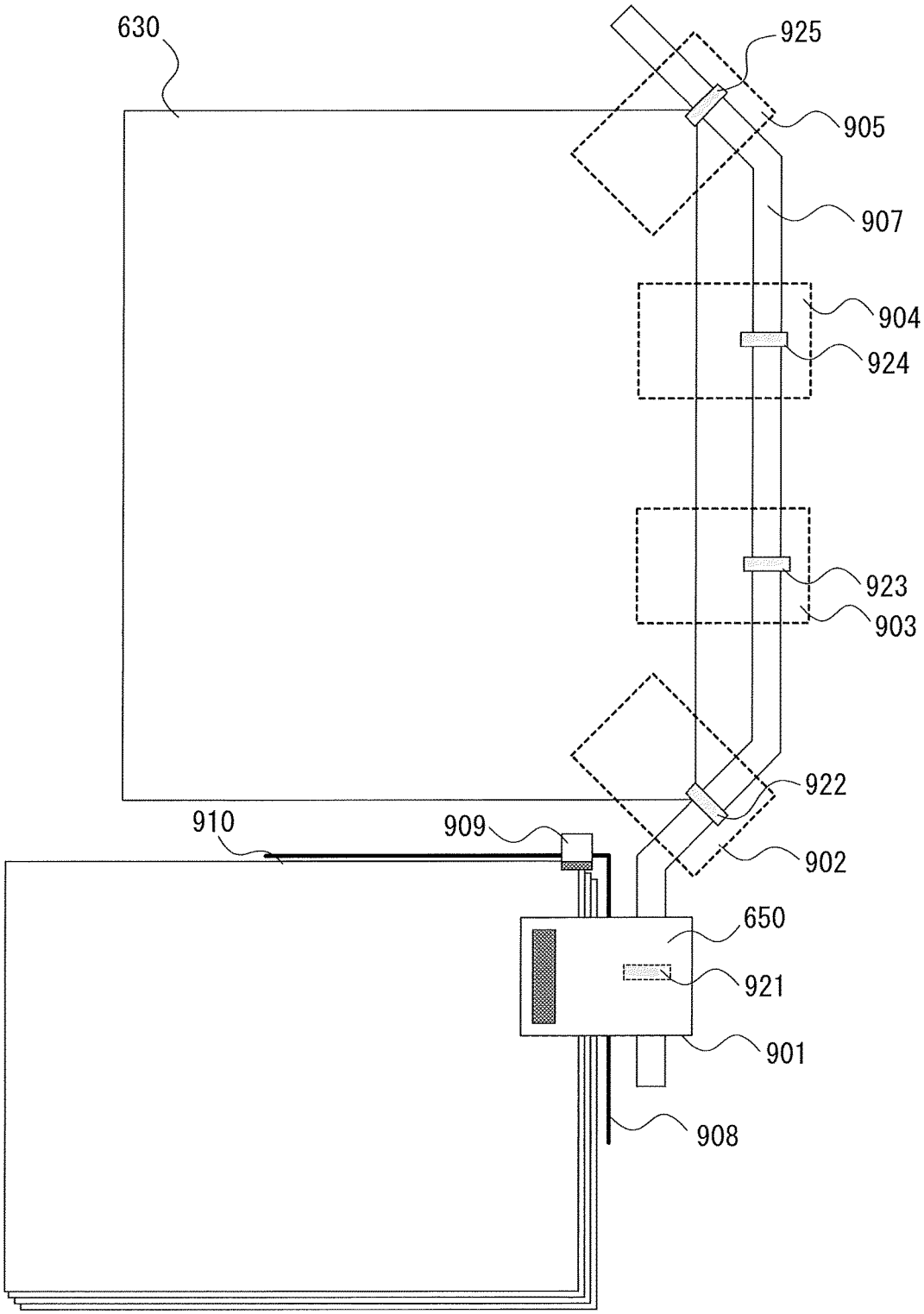
FIG. 4 is an explanatory diagram of a position of the stapler.

As mentioned, the binding processing includes the online-stapling and the offline-stapling. FIG. 3 is an explanatory diagram of a position of the stapler 650 when executing the online-stapling. FIG. 4 is an explanatory diagram of a position of the stapler 650 when executing the offline-stapling. FIGS. 3 and 4 are the diagrams when viewed the stapler 650 in FIG. 1 from the bundle delivery roller 690 side.

The stapler 650 is configured to be movable along a guide rail 907 when a stapler moving motor 911 drives a staple moving belt (not shown). The stapler 650 moves so as not to interfere with the sheet conveyed along the first finisher path 552 and the sheet delivered to the intermediate tray 630. When performing the online-stapling, the stapler 650 can perform corner binding and double binding. Through the corner binding, a corner of the sheet is bound. Through the double binding, two portions of rear edge of the sheet with respect to the sheet conveying direction are bound.

One or more positions are provided on the guide rail 907, which are positions allowing the stapler 650 to stop when performing the online-stapling. In the present embodiment, a home position 901, a corner binding front position 902, a double binding front position 903, a double binding rear position 904, and a corner binding rear position 905 are the positions allowing the stapler 650 to stop when performing the online-stapling. In FIG. 3, the stapler 650 is positioned at the double binding front position 903. These positions are the positions at which the stapler 650 performs the binding processing (binding position) when performing the online-stapling. The first stapler position sensor 921 is provided at the home position 901. The second stapler position sensor 922 is provided at the corner binding front position 902. The third stapler position sensor 923 is provided at the double binding front position 903. The fourth stapler position sensor 924 is provided at the double binding rear position 904. The fifth stapler position sensor 925 is provided at the corner binding rear position 905. The first to the fifth stapler position sensors 921 to 925 detect presence/absence of the stapler 650 and inputs the detection result into the second control unit 600. Due to this, the second control unit 600 can understand the position of the stapler 650.

The stapler 650 stands by at the home position 901 in a normal state and properly moves in accordance with an instruction of the binding position. The stapler 650 moves back to the home position 901 when the binding processing is finished. For example, when the stapler 650 moves from the home position 901 to the corner binding rear position 905, the CPU 601 instructs the stapler moving motor 911 to drive. When the detection result of the fifth stapler position sensor 925 is obtained, the CPU 601 stops to drive the stapler moving motor 911. Due to this, the stapler 650 can perform the binding processing at the corner binding rear position 905. The same processing is performed when performing the binding processing at the rest of the positions.

When performing the offline-stapling, the sheet bundle is inserted from outside of the image forming system and placed on the opening 910. The opening 910 is provided with a guide plate 908 to which the sheet bundle is abutted and the opening sheet bundle sensor 909 for detecting presence/absence of the sheet bundle of the opening 910. When the sheet bundle is detected, the opening sheet bundle sensor 909 inputs the detection result into the second control unit 600. In response to the detection result, the CPU 601 instructs the stapler 650 to perform the binding processing. When performing the offline-stapling, the stapler 650 stands by at the home position 901 and performs the binding processing in accordance with the instruction from the CPU 601. The home position 901 and the offline-stapling position are the same position.

(Time Chart)

Figure 5:
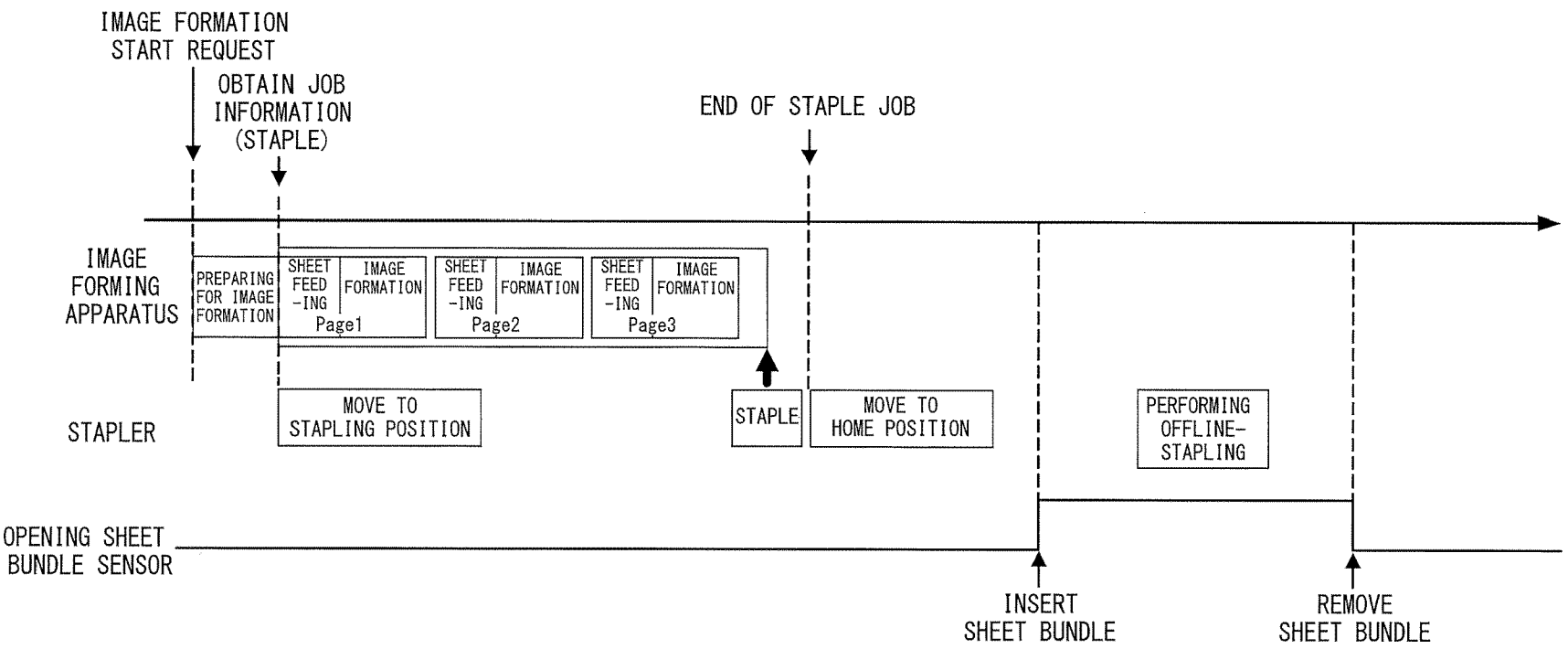
FIG. 5 is a time chart when performing the online-stapling and the offline-stapling.

FIG. 5 is a time chart when performing the online-stapling and the offline-stapling.

In response to a request to start image formation input from the operation unit 208 or the information processing apparatus 800, the CPU 201 of the first control unit 200 starts image forming preparation for performing image forming processing. When the image forming preparation is started, each component of the printer section 10 including the process unit 101 of each color, the laser scanner unit 104, the intermediate transfer body 108 and the like starts to drive. After the image forming preparation is started, the CPU 201 obtains job information from the operation unit 208 or the information processing apparatus 800. The job information includes instruction such as to instruct type of the sheet on which the image is formed, number of sheet bundles, type of the post-processing and the like. Based on the job information, the CPU 201 controls the operation of each component of the printer section 10 to perform processing such as sheet feeding from the sheet cassette 113, image forming processing and the like. If the binding processing is instructed in the job information, the CPU 201 determines that the online-stapling is required to be performed. Then, the CPU 201 requests the CPU 601 of the second control unit 600 to move the stapler 650 to the binding position instructed in the job information.

In response to the request from the CPU 201 of the first control unit 200 to move the stapler 650, the CPU 601 of the second control unit 600 moves the stapler 650 to the binding position instructed. When the binding processing is finished, the CPU 601 moves back the stapler 650 to the home position 901.

When the sheet bundle is inserted into the opening 910, the opening sheet bundle sensor 909 detects the insertion of the sheet bundle. Then, the detection result indicating the detection of the sheet bundle is input into the CPU 601 of the second control unit 600. In response to the detection result, the CPU 601 performs the offline-stapling. When the sheet bundle is removed from the opening 910, the opening sheet bundle sensor 909 detects the removal of the sheet bundle. Then, the detection result indicating the removal of the sheet bundle is input into the CPU 601.

Figure 6:
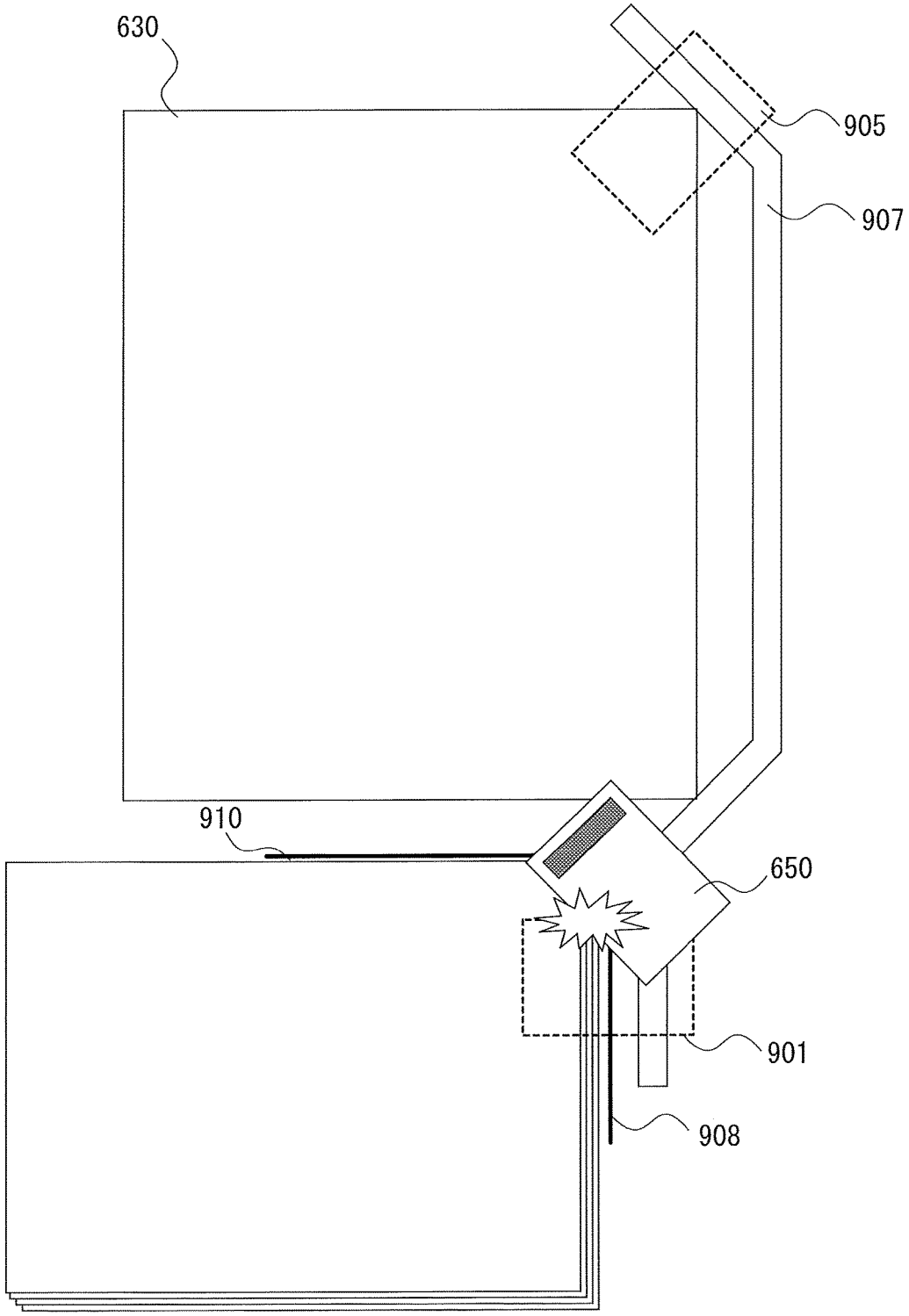
FIG. 6 is an explanatory diagram of interference of the sheet bundle with the stapler.
Figure 7:
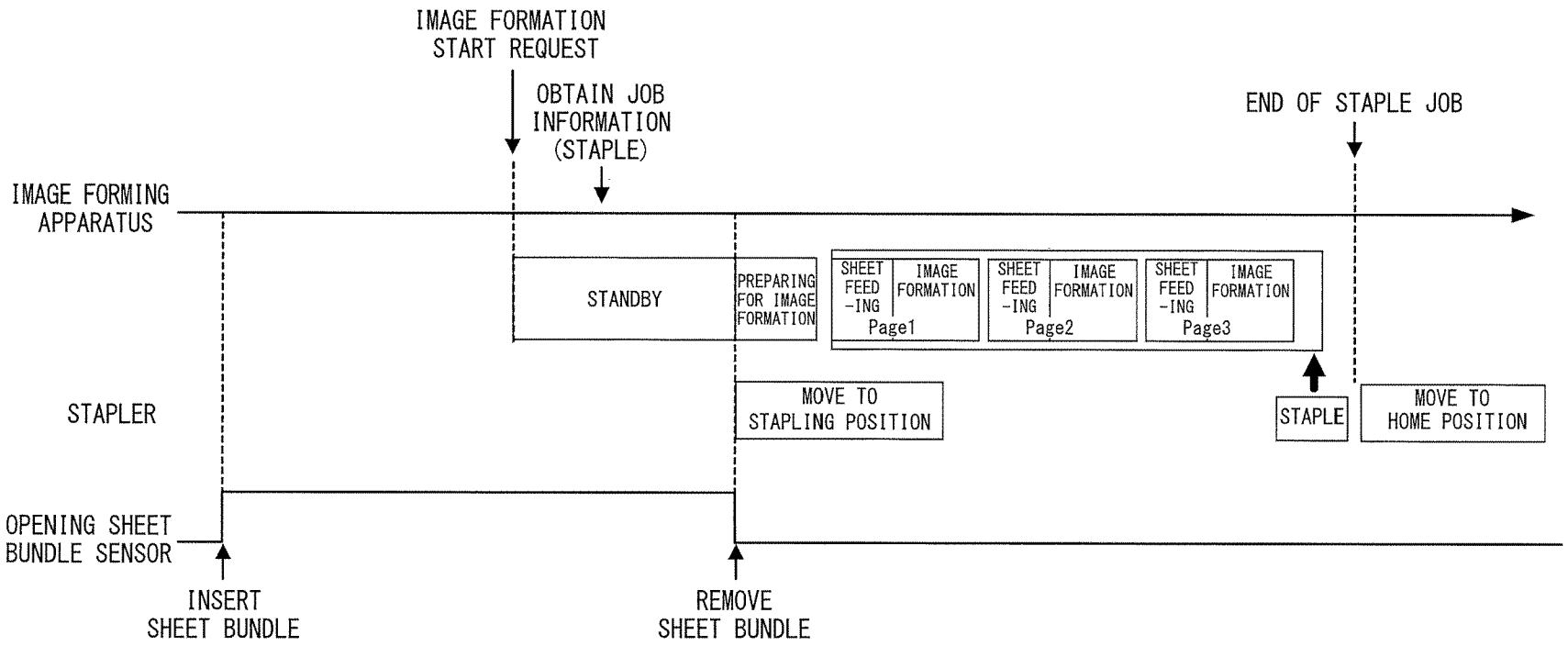
FIG. 7 is a time chart for preventing the interference.

When the stapler 650 moves in a state in which the sheet bundle is inserted into the opening 910, as shown in FIG. 6, the sheet bundle interferes with the stapler 650. This is because, by decreasing moving distance between the offline-stapling position and the online-stapling position to reduce the size of the finisher 500, the sheet bundle inserted into the opening 910 is positioned in the moving path of the stapler 650. FIG. 7 is a time chart showing operation to prevent such interference.

While the opening sheet bundle sensor 909 is detecting the sheet bundle, the CPU 601 of the second control unit 600 notifies the CPU 201 of the first control unit 200 that the sheet bundle is being inserted into the opening 910. While receiving the notification, the CPU 201 of the first control unit 200 waits to start image forming preparation operation regardless of the input of the request to start the image formation and does not request the CPU 601 of the second control unit 600 to move the stapler 650. When the CPU 601 of the second control unit 600 finishes notifying the CPU 201 of the first control unit 200 that the sheet bundle is being inserted into the opening 910, the CPU 201 of the first control unit 200 starts the image forming preparation operation and requests to move the stapler 650. It is noted that instead of continuously notifying while the sheet bundle is being inserted into the opening 910, the notification may be given when the sheet bundle is removed from the opening 910. It means that when the CPU 601 of the second control unit 600 notifies that the sheet bundle is removed from the opening 910, the CPU 201 of the first control unit 200 starts the image forming preparation operation and requests to move the stapler 650. In response to the request from the CPU 201 of the first control unit 200, the CPU 601 of the second control unit 600 moves the stapler 650 to the binding position instructed. It is noted that even the offline-stapling on the sheet bundle is finished, the CPU 601 restricts the movement of the stapler 650 until the sheet bundle is removed from the opening 910. So, the stapler 650 is made to stay at the offline-stapling position.

Figure 8:
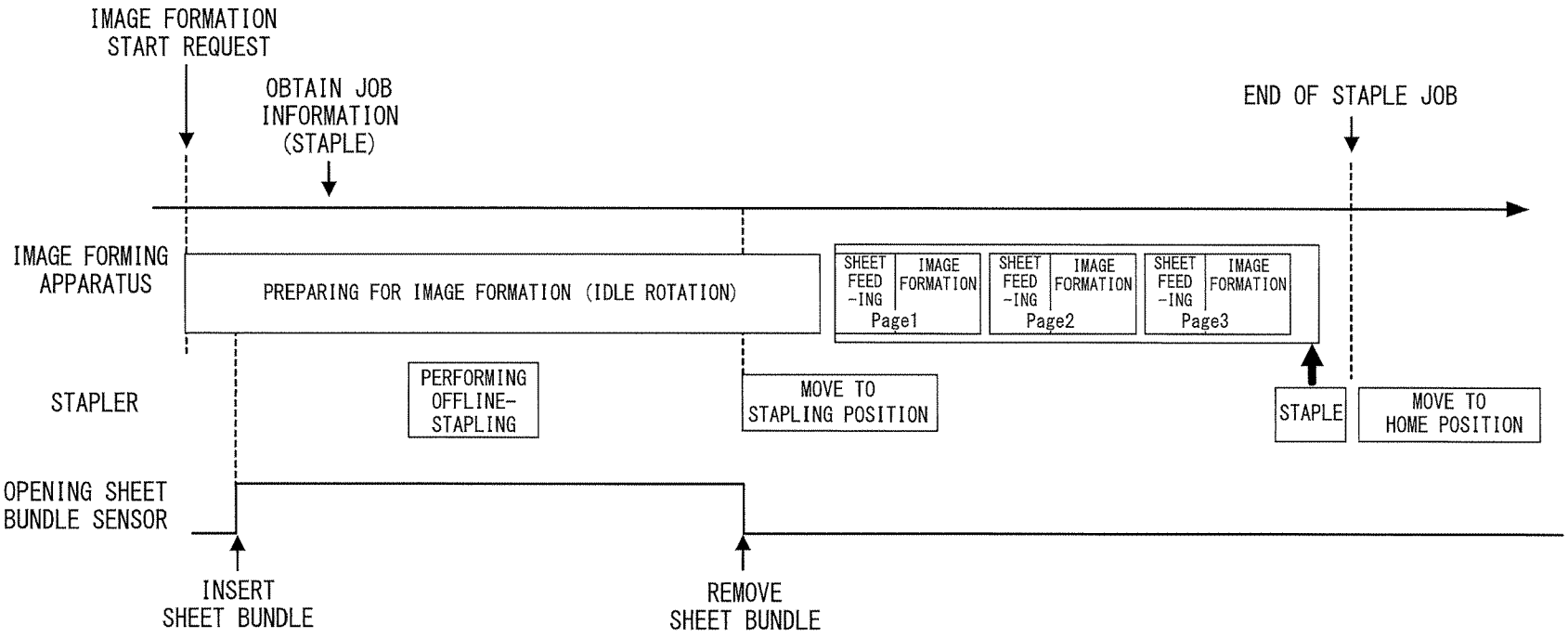
FIG. 8 is a time chart when the sheet bundle is inserted into the opening and the idle rotation is continued after the image forming preparation is started.

FIG. 8 is a time chart for a case where the image forming preparation operation is continued even after the sheet bundle is inserted into the opening 910 after starting the image forming preparation operation and before obtaining the job information including the binding processing (an example of a problem case).

In accordance with the job information, the CPU 201 of the first control unit 200 requests the CPU 601 of the second control unit 600 to move the stapler 650. However, if the CPU 601 of the second control unit 600 moves the stapler 650, the stapler 650 interferes with the inserted sheet bundle. This is because the sheet bundle is already inserted into the opening 910 before the CPU 201 of the first control unit 200 obtains the job information. Thereby, unless the CPU 601 of the second control unit 600 moves the stapler 650 to the online-stapling position, the printer section 10 cannot perform the image formation so that the idle rotation is caused even after the image forming preparation operation. It is noted that the idle rotation means a state, for example, in which the photosensitive drum 102 is being rotated even the laser scanner unit 104 does not expose light to the photosensitive drum 102. At this time, high voltage is continuously applied to the photosensitive drum 102 by the charging roller 103. Prolonged idle rotation of the photosensitive drum 102 gives an influence on the lifetime of the photosensitive drum 102. In the present embodiment, to prevent the occurrence of the idle rotation, the image forming system is operated in accordance with the time chart shown in FIGS. 9 and 10.

Figure 9:
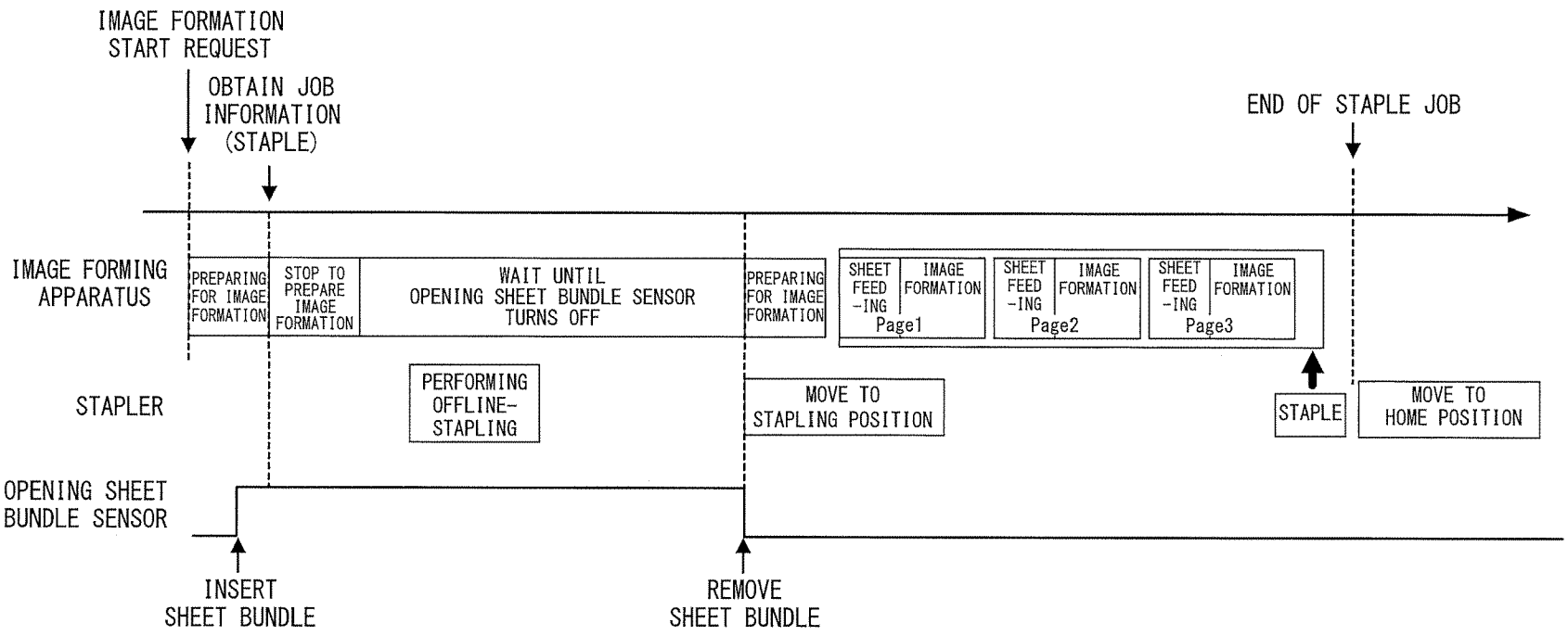
FIG. 9 is a time chart when the sheet bundle is inserted into the opening before starting the movement of the stapler.

FIG. 9 is a time chart for a case where the sheet bundle is inserted into the opening 910 before start of the movement of the stapler 650. It means that this is the processing when the sheet bundle is inserted into the opening 910 after starting the image forming preparation and before obtaining the job information including the binding processing. Before obtaining the job information, the CPU 601 of the second control unit 600 already notifies the CPU 201 of the first control unit 200 that the sheet bundle is detected by the opening sheet bundle sensor 909. Thereby, the printer section 10 stops the image forming preparation and turns to a standby state.

When the opening sheet bundle sensor 909 detects that the sheet bundle is removed from the opening 910, the CPU 201 of the first control unit 200 receives a notification from the CPU 601 of the second control unit 600 notifying that the sheet bundle is removed. In response to the notification, the CPU 201 of the first control unit 200 resumes the image forming preparation and requests to move the stapler 650. In response to the request to move the stapler 650 from the CPU 201 of the first control unit 200, the CPU 601 of the second control unit 600 moves the stapler 650 to the binding position instructed. The image forming apparatus 100 stops the image forming preparation while the sheet bundle is being inserted into the opening 910 so that the image forming apparatus 100 can prevent the occurrence of the idle rotation. Further, similar to the case shown in FIG. 7, even after the offline-stapling on the sheet bundle is finished, the movement of the stapler 650 is restricted until the sheet bundle is removed from the opening 910.

Figure 10:
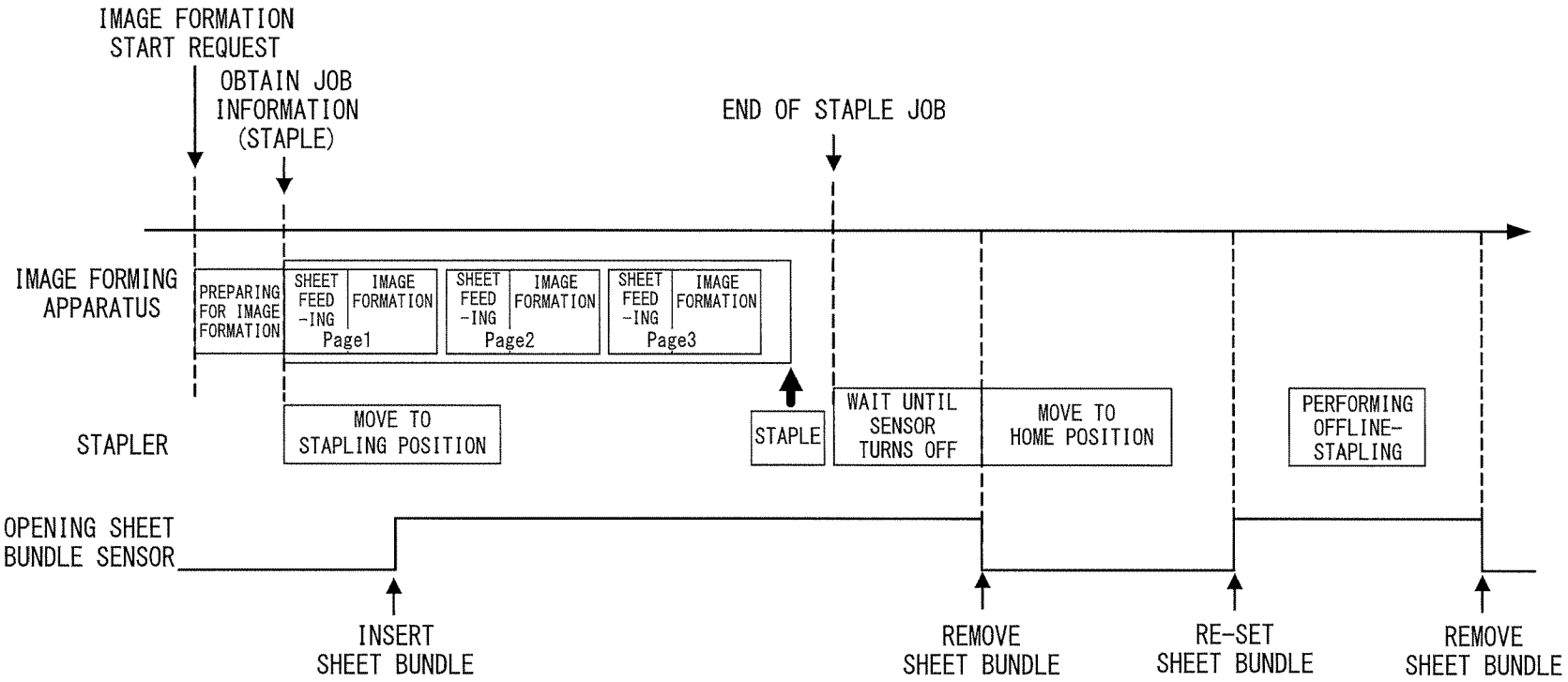
FIG. 10 is a time chart when the sheet bundle is inserted into the opening after starting the movement of the stapler.

FIG. 10 is a time chart for a case where the sheet bundle is inserted into the opening 910 after start of the movement of the stapler 650. In this case, the CPU 601 of the second control unit 600 moves the stapler 650 to the binding position and prioritizes the online-stapling. The CPU 201 of the first control unit 200 performs normal image forming processing.

After the online-stapling is finished, the CPU 601 of the second control unit 600 moves back the stapler 650 to the home position 901. At that time, the sheet bundle inserted into the opening 910 prevents the movement of the stapler 650. Thereby, while the sheet bundle is being inserted into the opening 910, i.e., while the opening sheet bundle sensor 909 is detecting the sheet bundle, the CPU 601 of the second control unit 600 does not move the stapler 650. If the sheet bundle is removed from the opening 910 and the opening sheet bundle sensor 909 detects the removal of the sheet bundle, the CPU 601 of the second control unit 600 moves back the stapler 650 to the home position 901.

It is noted that when the sheet bundle is inserted into the opening after the online-stapling, the CPU 601 of the second control unit 600 may notify the state to the CPU 201 of the first control unit 200. The CPU 201 of the first control unit 200 performs a display prompting a user to remove the sheet bundle from the opening 910 through the display of the operation unit 208. Further, when the sheet bundle is inserted into the opening 910, the CPU 601 of the second control unit 600 may move the stapler 650 just before a position where the stapler 650 interferes with the sheet bundle (a position where causes no interference) and may make the stapler 650 stay at the position until the sheet bundle is removed. Then, when the sheet bundle is removed, the CPU 601 of the second control unit 600 may move the stapler 650 to the home position 910.

(Operation Mode)

Figure 11:
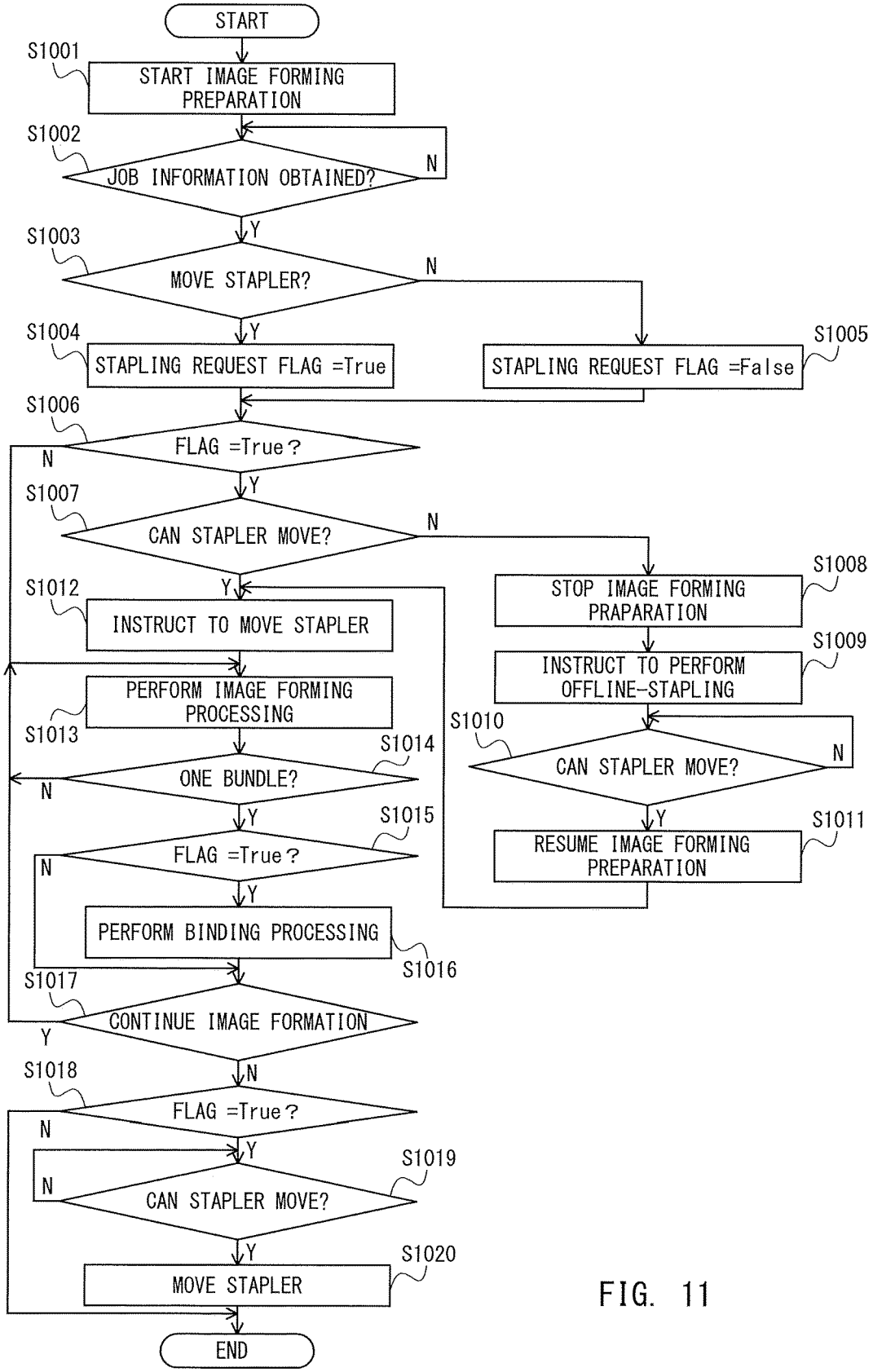
FIG. 11 is a flowchart for performing the image forming processing including the binding processing.

FIG. 11 is a flowchart for performing the image forming processing including the binding processing as mentioned. When the CPU 201 of the first control unit 200 receives the image forming request from the operation unit 208 or the information processing apparatus 800, the processing is started.

When the image forming request is received, the CPU 201 of the first control unit 200 starts the image forming preparation of the image forming apparatus 100 (S1001). The CPU 201 which started the image forming preparation waits until the job information is obtained (S1002). The CPU which obtained the job information (S1002: Y) determines whether an instruction to perform the binding processing is included in the job information obtained. If it is determined that the instruction to perform the binding processing is included, the CPU 201 confirms the binding position and determines whether the stapler 650 needs to move or not. If it is determined that the stapler 650 needs to move (S1003: Y), the CPU 201 sets "True" to a stapling request flag (S1004). If it is determined that the instruction to perform the binding processing is not included in the job information or if it is determined that the stapler 650 does not need to move (S1003: N), the CPU 201 sets "False" to the stapling request flag (S1005).

If "True" is set to the stapling request flag (S1006: Y), the CPU 201 of the first control unit 200 determines whether the stapler 650 can move without interfering with the sheet bundle or not (S1007). The CPU 201 of the first control unit 200 confirms whether the sheet bundle is placed on the opening 910 of the finisher 500 or not in accordance with the notification from the second control unit 600 in accordance with the detection result from the opening sheet bundle sensor 909. In response to the notification, the CPU 201 of the first control unit 200 determines whether the stapler 650 can move or not. If the sheet bundle is placed on the opening 910, the CPU 201 of the first control unit 200 determines that the stapler 650 cannot move. If the sheet bundle is not placed on the opening 910, the CPU 201 of the first control unit 200 determines that the stapler 650 can move.

If it is determined that the stapler 650 cannot move (S1007: N), the CPU 201 of the first control unit 200 stops the image forming preparation (S1008). The CPU 201 of the first control unit 200 instructs the CPU 601 of the second control unit 600 to perform the offline-stapling (S1009). Normally, the stapler 650 is positioned at the home position 901. Thereby, the CPU 601 of the second control unit 600 performs the offline-stapling in response to the instruction from the CPU 201 of the first control unit 200 without moving the position of the stapler 650.

After instructing to perform the offline-stapling, the CPU 201 of the first control unit 200 waits until the stapler 650 becomes movable (S1010). Similar to the processing of the step S1007, the CPU 201 of the first control unit 200 determines whether the stapler 650 can move or not. When the user removes the sheet bundle from the opening 910, the CPU 201 of the first control unit 200 determines that the stapler 650 becomes movable (S1010: Y). Then, the CPU 201 of the first control unit 200 resumes the image forming preparation (S1011).

If it is determined that the stapler 650 can move (S1007: Y), or after resuming the image forming preparation, the CPU 201 of the first control unit 200 instructs the CPU 601 of the second control unit 600 to move the stapler 650 to the binding position in accordance with the job information (S1012). When the stapler 650 is instructed to move, the CPU 601 of the second control unit 600 controls the stapler moving motor 911 to move the stapler 650 to the binding position instructed.

If "False" is set to the stapling request flag (S1006: N), or after instructing to move the stapler 650, the CPU 201 of the first control unit 200 performs the image forming processing based on the job information (S1013). The sheet having formed the image is sent to the finisher 500 from the image forming apparatus 100. It is noted that if the "False" is set to the stapling request flag, the stapler 650 is not instructed to move so that the stapler 650 stays at the home position 901.

The finisher 500 delivers the sheet having formed the image to be sent from the image forming apparatus 100 to the intermediate tray 630. Before the delivery, the CPU 201 of the first control unit 200 has confirmed the number of sheets consisting one bundle through the job information and sent this information to the second control unit 600. The CPU 601 of the second control unit 600 confirms the number of sheets delivered to the intermediate tray 630 and determines whether or not the number of sheets corresponding to one sheet bundle is delivered to the intermediate tray 630 (S1014). The finisher 500 comprises, for example, a sensor for detecting the sheet delivered to the intermediate tray 630. Based on the number of times of detection by the sensor, the CPU 601 of the second control unit 600 detects the number of the sheets delivered to the intermediate tray 630.

If the number of sheets corresponding to one bundle is delivered to the intermediate tray 630 (S1014: Y), the CPU 601 of the second control unit 600 determines whether the stapling request flag is "True" or not (S1015). For example, the CPU 601 of the second control unit 600 requests the control unit 200 to confirm the stapling request flag. By receiving the response to the request, the CPU 601 of the second control unit 600 confirms the stapling request flag.

If the stapling request flag is "True" (S1015: Y), the CPU 601 of the second control unit 600 causes the stapler 650 to perform the binding processing on the sheet bundle delivered to the intermediate tray 630 (S1016). The CPU 601 of the second control unit 600 delivers the sheet bundle having performed the binding processing to the delivery tray 700. If the stapling request flag is "False" (S1015: N), the CPU 601 of the second control unit 600 does not perform the binding processing and delivers the sheet bundle to the delivery tray 700 from the intermediate tray 630. When the sheet bundle is delivered to the delivery tray 700, the CPU 601 of the second control unit 600 notifies the delivery of the sheet bundle to the CPU 201 of the first control unit 200.

When receiving the notification from the CPU 601 of the second control unit 600 notifying the delivery of the sheet bundle, the CPU 201 of the first control unit 200 determines whether the image formation is continued or not based on the job information (S1017). If it is determined that the image formation is continued (S1017: Y), the CPU 201 of the first control unit 200 and the CPU 601 of the second control unit 600 repeatedly perform the processing after the step S1013 by number of times based on the job information. If it is determined that the image formation is not continued (S1017: N), the CPU 201 of the first control unit 200 notifies the CPU 601 of the second control unit 600 that the image forming processing is finished and ends the processing.

When the end of the image forming processing is notified, the CPU 601 of the second control unit 600 confirms the stapling request flag (S1018). If the stapling request flag is "False" (S1018: N), the CPU 601 of the second control unit 600 ends the processing as it is. If the stapling request flag is "True" (S1018: Y), the CPU 601 of the second control unit 600 waits until the stapler 650 becomes movable (S1019). If the opening sheet bundle sensor 909 detects that no sheet bundle is placed on the opening 910, the CPU 601 of the second control unit 600 determines that the stapler 650 can move (S1019: Y). When the stapler 650 becomes movable, the CPU 601 of the second control unit 600 causes the stapler moving motor 911 to move the stapler 650 to the home position and ends the processing (S1020).

As mentioned, when obtaining the image forming start request before the stapler 650 starts to move from the offline-stapling position, the image forming system of the present embodiment does not start to move the stapler 650 and does not perform the image forming preparation until the sheet bundle is removed from the opening 910. This prevents a situation in which the stapler 650 collides with the sheet bundle so that the sheet bundle is damaged. This also prevents a situation in which the image forming apparatus 100 idly rotates the component while preparing for the image formation. As a result, the surface of the photosensitive drum is prevented from being scraped and the deterioration of the developer is suppressed, which suppresses influence on the lifetime of the component.

While the present invention has been described with reference to exemplary embodiments and it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-128934, filed Jun. 26, 2015, which is hereby incorporated by reference wherein in its entirety.

What is claimed is:

1. An image forming apparatus comprising:

an image forming unit configured to form an image on a sheet;

a binding unit configured to perform binding processing on a sheet bundle formed of a plurality of the sheets;

a first sheet bundle placing portion on which a first sheet bundle formed of a plurality of sheets conveyed from the image forming unit is placed;

a second sheet bundle placing portion on which a second sheet bundle manually inserted by a user is placed, the second sheet bundle placing portion being different from the first sheet bundle placing portion;

a moving unit configured to move the binding unit between a first position and a second position along a moving path, the first position being a position for binding the sheet bundle placed on the first sheet bundle placing portion, the second position being a position for binding the sheet bundle placed on the second sheet bundle placing portion, and the moving path including a bent portion, wherein the binding unit is arranged such that if the moving unit moves the binding unit from the second position via the bent portion to the first position with the second sheet bundle being placed on the second sheet bundle placing portion, the binding unit interferes with the second sheet bundle placed on the second sheet bundle placing portion;

a detector configured to detect presence/absence of the second sheet bundle on the second sheet bundle placing portion; and a controller configured to control the image forming unit, the controller performing an image forming preparation operation for causing the image forming unit to be in a state in which the image forming is ready to start before starting an image forming, the image forming preparation operation including driving a part of the image forming unit without image forming;

wherein in a case where a print job is input and the binding unit is at the second position, the print job being an instruction to which the binding processing on the first sheet bundle to be placed on the first sheet bundle placing portion is designated, the controller is configured to:

(1) in a case where the detector does not detect the second sheet bundle, control the image forming unit to perform the image forming preparation operation, and control the moving unit to move the binding unit from the second position to the first position, and (2) in a case where the detector detects the second sheet bundle, control the image forming unit such that the image forming preparation operation is not performed, and control the moving unit such that the movement of the binding unit from the second position to the first position is not performed, then, if the detector no longer detects the second sheet bundle, control the image forming unit to perform the image forming preparation operation, and control the moving unit to move the binding unit to the first position.

2. The image forming apparatus according to claim 1, wherein the controller is further configured to:

in a case where the print job is input, the binding unit is at the second position, and the detector does not detect the second sheet bundle, control the image forming unit to perform the image forming preparation operation and control the moving unit to move the binding unit to the first position, thereafter, in a case where the detector detects the second sheet bundle during a period after starting of the image forming preparation operation and before moving the binding unit, control the image forming unit to stop the image forming preparation operation and to not perform the moving unit from moving the binding unit to the first position.

3. The image forming apparatus according to claim 2, wherein the controller is further configured to, after stopping of the image forming preparation operation and in a case where the detector no longer detects the second sheet bundle, control the image forming unit to restart the image forming preparation operation and control the moving unit to move the binding unit to the first position.

4. The image forming apparatus according to claim 2, wherein in a case where the print job is input, the binding unit is at the second position, and the detector does not detect the second sheet bundle, the controller is configured to control the image forming unit to perform image forming preparation operation and control the moving unit to move the binding unit to the first position, and the controller is further configured to control the image forming unit and the moving unit to continue image forming preparation operation and move the binding unit even if the detector detects the second sheet bundle after the image forming preparation operation and the moving of the binding unit are started.

5. The image forming apparatus according to claim 2, wherein the controller is further configured to allow the binding unit to bind the second sheet bundle at the second position in a case where the detector detects the second sheet bundle during a period after starting of the image forming preparation operation and before starting of movement of the binding unit.

6. The image forming apparatus according to claim 1, wherein the image forming apparatus further comprises a display unit for displaying information, and wherein the controller is further configured to perform a display prompting removal of the sheet bundle placed on the second sheet bundle placing portion on the display unit in a case where the detector detects the second sheet bundle when the print job has been completed and the binding unit is at the first position.

7. An image forming apparatus which is communicably connected to a sheet processing apparatus which comprises:

a binding unit configured to perform binding processing on a sheet bundle formed of a plurality of sheets;

a first sheet bundle placing portion on which a first sheet bundle formed of a plurality of sheets conveyed from the image forming apparatus is placed;

a second sheet bundle placing portion on which a second sheet bundle manually inserted by a user is placed, the second sheet bundle placing portion being different from the first sheet bundle placing portion;

a moving unit configured to move the binding unit between a first position and a second position along a moving path, the first position being a position for binding the sheet bundle placed on the first sheet bundle placing portion, the second position being a position for binding the sheet bundle placed on the second sheet bundle placing portion, and the moving path including a bent portion, wherein the binding unit is arranged such that if the moving unit moves the binding unit from the second position via the bent portion to the first position with the second sheet bundle being placed on the second sheet bundle placing portion, the binding unit interferes with the second sheet bundle placed on the second sheet bundle placing portion; and a detector configured to detect the second sheet bundle placed on the second sheet bundle placing portion, the image forming apparatus comprising:

an image forming unit configured to form an image on the sheet, a delivery unit configured to deliver the sheet having formed thereon the image to the sheet processing apparatus; and a controller configured to control the image forming unit, the controller performing an image forming preparation operation for causing the image forming unit to be in a state in which the image forming is ready to start before starting an image forming, the image forming preparation operation including driving a part of the image forming unit without image forming;

wherein in a case where a print job is input and the binding unit is at the second position, the print job being an instruction to which the binding processing on the first sheet bundle to be placed on the first sheet bundle placing portion is designated, the controller is configured to:

(1) in a case where the detector does not detect the second sheet bundle, control the image forming unit to perform the image forming preparation operation, and (2) in a case where the detector detects the second sheet bundle, control the image forming unit such that the image forming preparation operation is not started, and control the moving unit such that movement of the binding unit from the second position to the first position is not performed, then, if the detector no longer detects the second sheet bundle, control the image forming unit to perform the image forming preparation operation.

8. An image forming method performed by an apparatus which comprises:

an image forming unit configured to form an image on a sheet;

a binding unit configured to perform binding processing on a sheet bundle formed of a plurality of sheets;

a first sheet bundle placing portion on which a first sheet bundle formed of a plurality of sheets conveyed from the image forming unit is placed;

a second sheet bundle placing portion on which a second sheet bundle manually inserted by a user is placed, the second sheet bundle placing portion being different from the first sheet bundle placing portion;

a moving unit configured to move the binding unit between a first position and a second position along a moving path, the first position being a position for binding the sheet bundle placed on the first sheet bundle placing portion, the second position being a position for binding the sheet bundle placed on the second sheet bundle placing portion, and the moving path including a bent portion, wherein the binding unit is arranged such that if the moving unit moves the binding unit from the second position via the bent portion to the first position with the second sheet bundle being placed on the second sheet bundle placing portion, the binding unit interferes with the second sheet bundle placed on the second sheet bundle placing portion; and a detector configured to detect the second sheet bundle placed on the second sheet bundle placing portion, the image forming method comprising:

performing an image forming preparation operation for causing the image forming unit to be in a state in which the image forming is ready to start before starting an image forming, the image forming preparation operation including driving a part of the image forming unit without image forming;

performing, in a case where a print job is input and the binding unit is at the second position, the print job being an instruction to which the binding processing on the first sheet bundle to be placed on the first sheet bundle placing portion is designated:

(1) in a case where the detector does not detect the second sheet bundle, control of the image forming unit to perform the image forming preparation operation and control of the moving unit to move the binding unit to the first position, and (2) in a case where the detector detects the second sheet bundle, control of the image forming unit such that the image forming preparation operation is not started, and control of the moving unit such that the movement of the binding unit from the second position to the first position is not performed, then, if the detector no longer detects the second sheet bundle, control of the image forming unit to perform the image forming preparation operation, and control of the moving unit to move the binding unit to the first position.

9. An image forming apparatus comprising:

an image forming unit configured to form an image on a sheet;

a binding unit configured to perform binding processing on a sheet bundle formed of a plurality of the sheets;

a first sheet bundle placing portion on which a first sheet bundle formed of a plurality of sheets conveyed from the image forming unit is placed;

a second sheet bundle placing portion on which a second sheet bundle manually inserted by a user is placed, the second sheet bundle placing portion being different from the first sheet bundle placing portion;

a moving unit configured to move the binding unit between a first position and a second position along a moving path, the first position being a position for binding the sheet bundle placed on the first sheet bundle placing portion, the second position being a position for binding the sheet bundle placed on the second sheet bundle placing portion, and the moving path including a bent portion, wherein the binding unit is arranged such that if the moving unit moves the binding unit from the second position via the bent portion to the first position with the second sheet bundle being placed on the second sheet bundle placing portion, the binding unit interferes with the second sheet bundle placed on the second sheet bundle placing portion;

a detector configured to detect presence/absence of the second sheet bundle on the second sheet bundle placing portion; and a controller configured to control the image forming unit to perform an image forming preparation operation for causing the image forming unit to be in a state in which the image forming is ready to start before starting an image forming, the image forming preparation operation including driving a part of the image forming unit without image forming;

wherein the controller controls the image forming unit to perform the image forming preparation operation in a case where a print job is input, the binding unit is at the second position, and the detector does not detect the second sheet bundle, and wherein the controller controls the image forming unit such that the image forming preparation operation is not performed in a case where a print job is input, the binding unit is at the second position, and the detector detects the second sheet bundle, then, if the detector no longer detects the second sheet bundle, control the image forming unit to perform the image forming preparation operation.

* * * * *